United States Patent [19]

Abrosimov et al.

[11] Patent Number: 4,995,730

[45] Date of Patent: Feb. 26, 1991

[54] METHOD OF ELECTROMAGNETIC WORKING OF MATERIALS

[76] Inventors: Vladimir A. Abrosimov, ulitsa Krasnoborskaya, 1a, kv. 43; Viktor F. Luzev, ulitsa I Zhilaya, 14, kv. 6.; Vladimir N. Lyapunov, ulitsa Sovetskaya, 57, kv. 138., all of Yaroslavl; Jury N. Kuznetsov, Kashirskoe shosse, 142, korpus 3, kv. 279., Moscow; Vladimir B. Manerov, ulitsa Respublikanskaya, 77, kv. 110., Yaroslavl; Leon M. Skuinsh, ulitsa Tereshkovoi, 35b, kv. 7., Riga, all of U.S.S.R.

[21] Appl. No.: 288,235

[22] Filed: Dec. 22, 1988

[51] Int. Cl.[5] ..... B01F 13/08

[52] U.S. Cl. ..... 366/273; 366/348

[58] Field of Search ..... 366/2, 127, 150, 182, 366/273, 274, 348, 349; 241/1, 170; 34/10; 422/257, 1, 20, 22

[56] References Cited

U.S. PATENT DOCUMENTS

| | | | |
|---|---|---|---|
| 3,219,318 | 11/1965 | Hershler | 366/273 |
| 3,724,820 | 4/1973 | Bonjour et al. | 366/348 |
| 3,980,280 | 9/1976 | Benson | 366/348 |
| 3,987,967 | 10/1976 | Kuznetsov et al. | 366/273 X |
| 4,428,679 | 1/1984 | Fischer et al. | 366/177 |
| 4,527,904 | 7/1985 | Weetman | 366/349 |
| 4,621,927 | 11/1986 | Hiroi | 366/132 |

FOREIGN PATENT DOCUMENTS

| | | | |
|---|---|---|---|
| 0967542 | 10/1982 | U.S.S.R. | 366/273 |

*Primary Examiner*—Timothy F. Simone

*Attorney, Agent, or Firm*—Fleit, Jacobson, Cohn, Price, Holman & Stern

[57] ABSTRACT

The method of electromagnetic working of materials resides in producing a variable magnetic elements, and thus to treat the material fed into the working zone. The feed rate of the material to be worked is maintained within a range from 0.8 to 2.5 of the feed rate corresponding to the maximum active power consumed by the layer of the chaotically moving magnetic elements, the material being fed from below upwards through the layer of the magnetic elements.

2 Claims, 1 Drawing Sheet

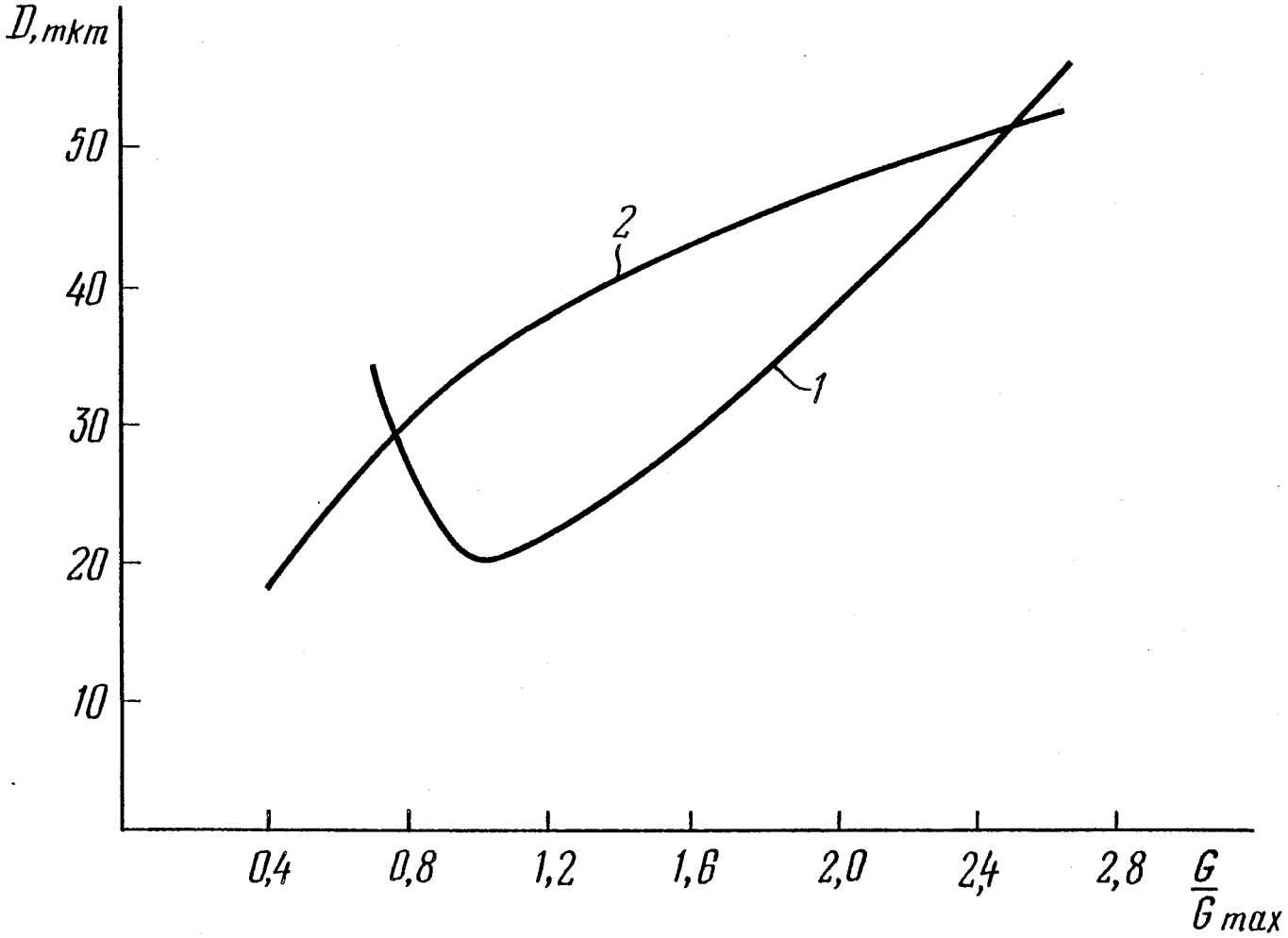
D, mkm
50
40
30
20
10
0,4
0,8
1,2
1,6
2,0
2,4
2,8
G/G max
1
2

METHOD OF ELECTROMAGNETIC WORKING OF MATERIALS

BACKGROUND OF THE INVENTION

1. Field of the Invention

The invention relates to electromagnetic working of materials, and more particularly it relates to a method of electromagnetic working of materials.

The invention can be utilized for dispersing, emulsifying and mixing suspensions, predominantly in the chemical and related industries.

2. Description of the Prior Art

There is known a method of electromagnetic working of materials (U.S. Pat. No. 3,219,318) residing in producing a variable magnetic field to induce chaotic motion of magnetic elements with the aim of working, e.g. dispersing or mixing, a material fed into the working zone, e.g. a suspension or emulsion.

The method is intended for working materials in relatively small receptacles or vessels, e.g. test tubes or laboratory glasses.

Devices capable of performing this method comprise an electric winding operable to generate a variable magnetic field in the working zone, and a working chamber of a non-magnetic material accommodating therein magnetic elements. The quantity of magnetic elements in the working chamber is selected so that in their motion they should be adequately spaced from one another and not subjected to frequent collisions and excessive wear incurred by such collisions.

This quantity of magnetic elements is short of their distribution in one layer over the entire area of the bottom of the chamber.

A shortcoming of this known method is its relatively low efficiency on account of incomplete utilization of the energy of the magnetic field in the working volume, caused by the relatively small quantity of the magnetic elements; another shortcoming is the specific productivity of the process declining and its efficiency decreasing with the dimensions of the working chamber and its volume being increased, with a sharp rise of the energy input, which prohibits the creation of high-efficiency units of adequate productivity and throughput.

There is known another method of electromagnetic working of materials (U.S. Pat. No. 3,987,967), which includes acting upon a material received in the working zone by magnetic elements moving chaotically under the action thereupon of a variable magnetic field, the elements being accommodated in the working zone in a layer of which the height is determined by the geometrical dimensions of the magnetic elements, their magnetic parameters and density, and also by the intensity and frequency of the magnetic field.

A shortcoming of this method of the prior art is inadequate quality of the working of materials in a continuous duty, relatively high energy inputs and insufficient intensity of the working process. This is caused by the fact that when the working of suspensions is conducted in a continuous process, a considerable part of the volume of the suspension passes either through or above the layer of magnetic elements without being adequately treated. The probability of such slipping-through of unworked suspension lowers with a growing height of the layer of magnetic elements accommodated in the working zone. However, the height of their layer in the working zone in the method of the prior art is relatively limited, and in practical implementations would not be made in excess of 20–30 cm on account of the growing moment of resistance to the motion of the magnetic elements caused by gravity forces; in other words, when magnetic elements are loaded into the working zone in a layer exceeding 20–30 cm, those of the magnetic elements which are close to the bottom of this layer would remain all but stationary and not take part in useful work.

Furthermore, the method of the prior art would not provide for monitoring and maintaining an optimized height of the layer of magnetic elements throughout the operation, as the process of the working of materials, and of abrasive suspensions and pastes in particular, is accompanied by the wearing away of the magnetic elements, with the products of such wear being carried away by the materials being worked, so that the mass and height of the layer of the magnetic elements in the working zone declines, and the efficiency and quality of the working operation declines correspondingly.

SUMMARY OF THE INVENTION

It is an object of the present invention to intensify the process of electromagnetic working of materials.

It is another object of the present invention to raise the quality of electromagnetic working of materials.

It is yet another object of the present invention to reduce the energy input into electromagnetic working of materials.

These and other objects are attained in a method of electromagnetic working of materials, residing in continuously feeding into the working zone a stream of material to be worked, the working zone accomodating therein a layer of magnetic elements and having a variable magnetic field generated therein to actuate the layer of chaotically moving magnetic elements to work the material being fed, which method, in accordance with the present invention, further includes maintaining the feed rate of the material being worked within a range from 0.8 to 2.5 of the feed rate corresponding to the maximum active power consumed by the layer of chaotically moving magnetic elements, and feeding the material to be worked from below upwards through the layer of the magnetic elements.

It is further expedient that in the method of the invention the height of the layer of the magnetic elements should be maintained by monitoring the differential of the respective intensities of the varying magnetic field at the uppermost and lowermost parts of the working zone containing the moving magnetic elements.

The invention will be further described in connection with examples of its implementation, with reference being made to the accompanying drawing plotting the dependence of the degree of dispersity (fineness) of a treated suspension on its feed rate in conditional units, based on experimentally obtained data.

The disclosed method of electromagnetic working of materials is based on producing a variable magnetic field by an electric winding, placing into this field a housing having loaded therein a layer of magnetic elements, and feeding upwards through this layer of magnetic elements from below a stream of a material to be treated a fluid, suspension or emulsion. A wattmeter is used to measure the power consumed by the layer of the chaotically moving magnetic elements, and the feed rate of the material to be worked is set within a range from 0.8 to 2.5 of the feed rate corresponding to the maximum active power. The nominal height of the layer of magnetic elements in the working zone of the housing is preferably maintained by monitoring the differential of the intensities of the variable magnetic field in the uppermost and lower most parts of the working zone.

In the appended drawing, Curve 1 illustrates the dependence of the degree of dispersity (fineness) of a suspension having been worked on its feed rate in conditional units in the method of the present invention, and Curve 2 illustrates similar dependence in the method of the prior art, based on experimentally obtained data.

Given below are several examples of implementation of the method of the present invention.

EXAMPLE 1

Consider the process of dispersion of a pigment-containing varnish suspension composed of, % by weight:

| | |
|---|---|
| iron minimum | 13.3 |
| talcum | 8.5 |
| zinc tetraoxychromate | 8.5 |
| zinc white | 7.6 |
| bentonite | 0.5 |
| phenol-oil varnish | 49.6 |
| white spirit | 6.0 |
| xylene | 6.0 |

The working is conducted in a housing of a non-magnetic material, of the internal diameter of 15 cm and length of 80 cm.

The magnetic elements used are barium hexaferrite granules of remanent induction $B_r=1600$ gausses, coercive magnetization force ${}_IH_c=2000$ oersteds, mean particle size 0.2 cm, density 4.8 g/cm$^3$.

The amplitude of the magnetic field of a 50 Hz frequency is selected to be the maximum possible intensity for the magnetic elements used, at 1600 oersteds.

The magnetic elements are loaded into the housing in the quantity of 18 kg. The housing is placed inside an electric winding - an inductor composed of 6 coils 15 cm thick of copper wire. The inductor is supplied with power from a 380 V, 50 Hz source.

The treatment of the suspension is conducted by continuously feeding the suspension from below upwards through the layer of the magnetic elements with the housing arranged vertically, and the height of the layer of the magnetic elements in the housing amounting to 76 cm.

By varying the delivery of the pump feeding the suspension and watching the readings of the wattmeter wired into the circuit of the electric winding, the maximum value of the active power consumed by the electric winding from the power mains is established.

The maximum value of the active power thus established is 4500 W, and the feed rate of the suspension corresponding to this value is 160 kg/hour. The fineness of the suspension thus treated is 20 μm, with the initial fineness of 150 μm. The power input is 28.75 kW.h per 1000 kg. With the feed rate of suspension maintained at 128 kg/hour and 400 kg/hour amounting, respectively, to 0.8 and 2.5 of the feed rate corresponding to the maximum power consumption, the fineness of the suspended matter is 30 μm and 50 μm, and the power input is 21.3 kW.h and 8.2 kW.h per 1000 kg, respectively.

For comparison sake, the same magnetic elements were operated for working the suspension by the method of the prior art, with the suspension fed through the layer of the magnetic elements in the housing arranged horizontally, and with the height of the layer of the magnetic element being maintained at the maximum value for the method of the prior art, i.e. at 13.5 cm.

In this case, the total mass of the magnetic elements loaded into the housing was the same as in the first-described case, i.e. 18 kg. A similar quality of the treated suspension (20 μm fineness of the suspended matter) was obtained with the feed rate of the suspension through the chamber equalling 70 kg/hour and the energy input of 52 kW.h per 1000 kg. The fineness of 30 μm and 50 μm with the feed rates of 120 kg/hour and 380 kg/hour was obtained with the power inputs of 30 kW.h and 11.9 kW.h per 1000 kg, respectively.

It can be seen from the above example of implementation of the process and from its illustration in the appended drawing that the disclosed method including the feeding of the stream of the material to be treated upwards through the layer of the magnetic elements from below provides for more intense and higher-quality working of the suspension with less energy consumed. The advantages of the disclosed method are retained with feed rates of the material to be treated within a range from 0.8 to 2.5 of the feed rate corresponding to the maximum active power consumed by the layer of the moving magnetic elements.

With the feed rate of the material below 0.8 of the feed rate corresponding to the maximum active power consumed, the dynamic head of the stream is insufficient for compensating for gravity forces, so that the magnetic elements at the bottom of the layer are practically immobile, which downgrades the working quality and steps up the power input on account of the prolonged duration of the process.

When the feed rate exceeds 2.5 of the value corresponding to the consumption of the maximum active power, distance between individual magnetic elements increases, the active power consumed drops due to the high dynamic head of the steam of the material to be treated, the slipping-through of the untreated material grows, and the working quality ultimately declines.

EXAMPLE 2

Consider the process of dispersion of pigment-containing lacquer suspension composed of, % by weight:

| | |
|---|---|
| commercial carbon | 15.5 |
| glyptal lacquer | 34.0 |
| carbamide resin | 18.5 |
| xylene | 32.0 |

The treatment is conducted in a housing made of non-magnetic chrome-nickel steel. The inner diameter of the housing is 220 mm and its height is 1400 mm. The magnetic elements used are spherical magnets of barium hexaferrite, of a 2.5 mm mean diameter. The magnetic elements are initially loaded into the housing in a quantity of 120 kg. The housing is placed into the working zone, i.e. into a vertically arranged inductor made of 12 successive sections. The height of the layer of the magnetic elements in the housing is 1160 mm. The inductor is fed from 380 V, 50 Hz mains, generating a magnetic field of 500 oersteds.

The suspension is treated in such a way that it is continuously fed by a pump from below into the layer of the magnetic elements in the housing. The feed rate of the suspension to be treated is varied by varying the delivery of the feed pump, and the readings of a wattmeter wired into the circuit of the electric windings are watched to set and maintain the maximum value of the active power consumed from the mains supplying the winding.

The maximum value of the active power consumed is 15–17 kW.

The differential of the intensities of the variable magnetic field in the uppermost and lowermost parts of the working zone where the magnetic particles move is measured by means of a voltmeter, by comparing the voltage drops, respectively, at the sections of the electric winding enclosing the uppermost part of the working zone and the lowermost part of the working zone.

It is essential to measure the voltage drop differential between at least two sections of the electric winding, of which one encloses the uppermost part of the working zone and the other one encloses the lowermost part of the working zone. The sections are connected in series and have the same number of turns and, consequently, the same inductance. A voltmeter is connected in parallel with either section to indicate the voltage drops across the respective sections. When the working zone is filled with the magnetic elements to up the top level of the uppermost section, the readings of the two voltmeters would be substantially the same as the inductive impedances of the two section would be equal. Thus, the voltage drop differential would be close to zero.

When the height of the layer up to which the magnetic elements are loaded into the working zone lowers due to the wearing away of the elements in operation, the inductive impedance of the topmost section would lower, too, as the magnetic elements with their magnetic permeability in excess of 1.0 play the role of a magnetic core. Consequently, the voltage drop across the topmost section would lower, and the voltage drop across the lowermost section would rise owing to the growing total current in the series circuit. The readings of the voltmeters associated with the topmost and lowermost sections would become different, with the differential growing with the lowering height of the layer of the magnetic elements. This differential of the readings of the two voltmeters is monitored for loading additional magnetic elements into the working chamber until the readings of the two voltmeters level out, i.e. return to the initial state corresponding to the optimum level of the layer of the magnetic elements in the working chamber. The operation of loading additional magnetic elements can be either manual or automatic.

The material is treated by being pumped through the layer of the magnetic elements in an upward flow.

The nominal rate of this flow, i.e. the feed rate of the material to be treated, is maintained in correspondence with the readings of the wattmeter wired into the circuit of the electric winding, by varying the delivery of the pump.

4 tons of the varnish suspension of the abovestated composition are thus treated, the total working time being 8 hours. After 1 hour of operation the voltage differential read by the two voltmeters grows from the initial value of 0.2 V to 3.0 V. To minimize this differential of the readings of the two voltmeters, 2 kg of magnetic elements are additionally loaded into the working zone. Depending on the different intensities of the variable magnetic field at the uppermost and lowermost parts of the working zone where the magnetic elements move, additional magnetic elements are loaded in the course of the working process, in which way the optimum height of their layer is maintained. Altogether, 15.8 kg of the magnetic elements are loaded additionally over the 8 hours of treatment. The fineness of the suspension thus treated is 10 μm against the initial fineness of 150 μm. The energy input is 32 kW.h per 1 ton. The height of the layer of the magnetic elements by the end of the treatment equals the initial height.

For comparison sake 4 tons of the same suspension were treated under the same conditions, but without replenishing the layer of the magnetic elements in the working zone.

The total time of treating the suspension to the final fineness of 10 μm was 11.5 hours, and the energy input was 43 kW.h per 1 ton. The height of the layer of the magnetic elements in the working zone by the end of the treatment was 15% below the initial nominal height.

It can be seen from the above examples that the implementation of the disclosed method of electromagnetic working of materials provides for uniform intense working of the materials in the layer of moving magnetic elements, irrespective of the actual height of the layer, while supporting the required quality of the working with lower energy inputs and higher efficiency.

What is claimed is:

1. A method of electromagnetic working of materials, including:

providing a working zone having an uppermost part and a lowermost part;

producing a variable magnetic field in said working zone;

placing in said working zone a layer of magnetic elements capable of moving chaotically under the action thereupon of said variable magnetic field and measuring a maximum active power consumed by said layer of the chaotically moving magnetic elements;

feeding a continuous stream of a material into said working zone from below upward through said layer of magnetic elements, for said stream of the material to be worked by said magnetic elements; and maintaining the feed rate of said stream of the material within a range from 0.8 to 2.5 of the feed rate corresponding to the maximum active power consumed by said layer of chaotically moving magnetic elements.

2. A method as claimed in claim 1, wherein the height of said layer of magnetic elements is maintained by monitoring the differential of the intensities of said variable magnetic field, respectively, in said uppermost part of said working zone and in said lowermost part of said working zone containing said layer of chaotically moving magnetic elements.

* * * * *